US010417996B2

(12) United States Patent
Yin et al.

(10) Patent No.: US 10,417,996 B2
(45) Date of Patent: Sep. 17, 2019

(54) METHOD, IMAGE PROCESSING DEVICE, AND DISPLAY SYSTEM FOR POWER-CONSTRAINED IMAGE ENHANCEMENT

(71) Applicant: Yuan Ze University, Taoyuan County (TW)

(72) Inventors: Jia-Li Yin, Taoyuan (TW); Bo-Hao Chen, New Taipei (TW); En-Hung Lai, Taoyuan (TW); Ling-Feng Shi, Fujian (CN)

(73) Assignee: Yuan Ze University, Taoyuan County (TW)

( * ) Notice: Subject to any disclaimer, the term of this patent is extended or adjusted under 35 U.S.C. 154(b) by 0 days.

(21) Appl. No.: 15/807,593

(22) Filed: Nov. 9, 2017

(65) Prior Publication Data

US 2019/0066629 A1 Feb. 28, 2019

(30) Foreign Application Priority Data

Aug. 31, 2017 (TW) ..... 106129840 A

(51) Int. Cl.
*G09G 5/10* (2006.01)

(52) U.S. Cl.
CPC ..... *G09G 5/10* (2013.01); *G09G 2320/0276* (2013.01); *G09G 2320/066* (2013.01); *G09G 2330/023* (2013.01)

(58) Field of Classification Search
None
See application file for complete search history.

(56) References Cited

U.S. PATENT DOCUMENTS 6,160,532 A 12/2000 Kaburagi et al.
7,164,442 B2 1/2007 Takane
(Continued)

FOREIGN PATENT DOCUMENTS

CN 101510393 8/2009
CN 102915695 2/2013
(Continued)

OTHER PUBLICATIONS

Yeon-Oh Nam et al., "Power-Constrained Contrast Enhancement Algorithm Using Multiscale Retinex for OLED Display," IEEE Transactions on Image Processing, vol. 23, No. 8, Aug. 2014, pp. 3308-3320.

(Continued)

*Primary Examiner* — Yanna Wu
(74) *Attorney, Agent, or Firm* — JCIPRNET

(57) ABSTRACT

A method, an image processing device, and a display system for power-constrained image enhancement are proposed. The method is applicable to an image processing device and includes the following steps. First, an input image is received and inputted into a power-constrained sparse representation (PCSR) model, where the PCSR model is associated with a sparse representation model and a power-constraint model, where the sparse representation model is associated with an over-complete dictionary and sparse codes, and where the power-constrained model is associated with pixel intensities of the input image and a gamma correction value of a display Next, a reconstructed image outputted by the PCSR model is obtained and displayed on the display.

18 Claims, 4 Drawing Sheets

(56) References Cited

U.S. PATENT DOCUMENTS

| | | | |
|---|---|---|---|
| 8,284,138 | B2 | 10/2012 | Yamazaki et al. |
| 8,290,251 | B2 | 10/2012 | Mahajan et al. |
| 8,441,419 | B2 | 5/2013 | Ozawa et al. |
| 8,482,698 | B2 | 7/2013 | Atkins |
| 8,483,500 | B2 | 7/2013 | Nguyen et al. |
| 8,836,619 | B2 | 9/2014 | Ozawa et al. |
| 8,941,580 | B2 | 1/2015 | Li et al. |
| 9,152,881 | B2 | 10/2015 | Brumby et al. |
| 9,202,416 | B2 | 12/2015 | Ozawa et al. |
| 9,256,806 | B2 | 2/2016 | Aller et al. |
| 9,269,024 | B2 | 2/2016 | Chan et al. |
| 9,529,409 | B2 | 12/2016 | Sullivan et al. |
| 2015/0003749 | A1 | 1/2015 | Kim et al. |
| 2017/0091964 | A1* | 3/2017 | Luo ..... G06T 11/006 |

FOREIGN PATENT DOCUMENTS

| | | |
|---|---|---|
| CN | 102930518 | 2/2013 |
| CN | 102945552 | 2/2013 |
| CN | 103168284 | 6/2013 |
| CN | 104063857 | 9/2014 |
| CN | 104134204 | 11/2014 |
| TW | I366179 | 6/2012 |
| TW | I534784 | 5/2016 |

OTHER PUBLICATIONS

Suk-Ju Kang, "Image-Quality-Based Power Control Technique for Organic Light Emitting Diode Displays," Journal of Display Technology, vol. 11, No. 1, Jan. 2015, pp. 104-109.

Suk-Ju Kang, "Perceptual Quality-Aware Power Reduction Technique for Organic Light Emitting Diodes," Journal of Display Technology, vol. 12, No. 6, Jun. 2016, pp. 519-525.

"Office Action of Taiwan Counterpart Application", dated Apr. 26, 2018, p. 1-p. 5.

* cited by examiner

METHOD, IMAGE PROCESSING DEVICE, AND DISPLAY SYSTEM FOR POWER-CONSTRAINED IMAGE ENHANCEMENT

CROSS-REFERENCE TO RELATED APPLICATION

This application claims the priority benefit of Taiwan application serial no. 106129840, filed on Aug. 31, 2017. The entirety of the above-mentioned patent application is hereby incorporated by reference herein and made a part of this specification.

TECHNICAL FIELD

The disclosure relates to a method, an image processing device, and a display system, in particular to, a method, an image processing device, and a display system for power-constrained image enhancement.

BACKGROUND

Display panels are widely used in many consumer devices, and thus numerous battery power-saving techniques have been proposed. However, the existing approaches would normally result in either underexposure effects or color tone changes in a reconstructed image with an adverse visual outcome.

SUMMARY OF THE DISCLOSURE

A method, an image processing device, and a display system for power-constrained image enhancement are proposed, where contrast enhancement on output images as well as power saving on a display are provided.

According to one of the exemplary embodiments, the image enhancement method is applicable to an image processing device and includes the following steps. First, an input image is received and inputted into a power-constrained sparse representation (PCSR) model, where the PCSR model is associated with a sparse representation model and a power-constrained model, where the sparse representation model is associated with an over-complete dictionary and sparse codes, and where the power-constrained model is associated with pixel intensities of the input image and a gamma correction value of a display Next, a reconstructed image outputted by the PCSR model is obtained and displayed on the display.

According to one of the exemplary embodiments, the image processing device includes a memory and a processor, where the processor is coupled to the memory. The memory is configured to store data and images. The processor is configured to receive an input image, input the input image to a PCSR model, receive a reconstructed image outputted by the PCSR model, and display the reconstructed image on the display, where the PCSR model is associated with an over-complete dictionary and sparse codes, and where the sparse representation model is associated with pixel intensities of the input image and a gamma correction value of a display.

According to one of the exemplary embodiments, the display system includes a display and an image processing device. The display is configured to display images. The image processing device is connected to the display and configured to receive an input image, input the input image to a PCSR model, receive a reconstructed image outputted by the PCSR model, and display the reconstructed image on the display, where the PCSR model is associated with an over-complete dictionary and sparse codes, and where the sparse representation model is associated with pixel intensities of the input image and a gamma correction value of a display.

In order to make the aforementioned features and advantages of the present disclosure comprehensible, preferred embodiments accompanied with figures are described in detail below. It is to be understood that both the foregoing general description and the following detailed description are exemplary, and are intended to provide further explanation of the disclosure as claimed.

It should be understood, however, that this summary may not contain all of the aspect and embodiments of the present disclosure and is therefore not meant to be limiting or restrictive in any manner. Also the present disclosure would include improvements and modifications which are obvious to one skilled in the art.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

Figure 1:
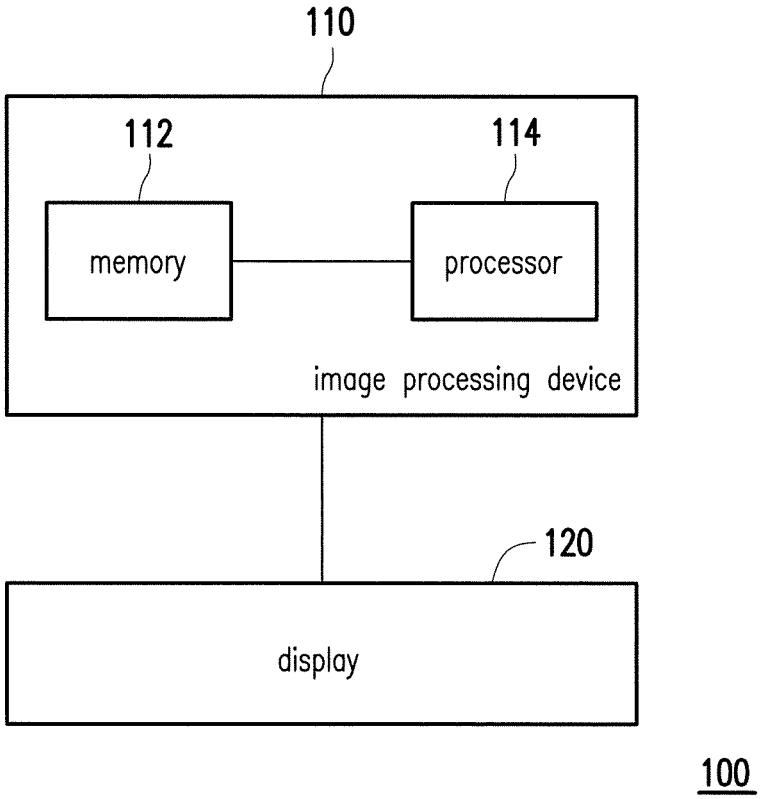
FIG. 1 illustrates a schematic diagram of a proposed display system in accordance with one of the exemplary embodiments of the disclosure.

To make the above features and advantages of the application more comprehensible, several embodiments accompanied with drawings are described in detail as follows.

DESCRIPTION OF THE EMBODIMENTS

Some embodiments of the disclosure will now be described more fully hereinafter with reference to the accompanying drawings, in which some, but not all embodiments of the application are shown. Indeed, various embodiments of the disclosure may be embodied in many different forms and should not be construed as limited to the embodiments set forth herein; rather, these embodiments are provided so that this disclosure will satisfy applicable legal requirements. Like reference numerals refer to like elements throughout.

FIG. 1 illustrates a schematic diagram of a proposed display system in accordance with one of the exemplary embodiments of the disclosure. All components of the display system and their configurations are first introduced in FIG. 1. The functionalities of the components are disclosed in more detail in conjunction with FIG. 3.

Referring to FIG. 1, a display system 100 would include an image processing device 110 and a display 120, where the image processing device 110 would be connected to the display 120 and at least include a memory 112 and a processor 114. In the present exemplary embodiment, the display system 100 may be a stand-alone device integrated by the image processing 110 and the display 120, such as a laptop computer, a digital camera, a digital camcorder, a smart phone, a tabular computer, an event recorder, or an in-vehicle multimedia system. In another exemplary embodiment, the image processing device 110 of the display system 100 may be a computer system, such as a personal computer or a server computer, that is wired or wirelessly connected to the display 120. The disclosure is not limited in this regard.

The memory 112 of the image processing device 110 would be configured to store video images and data and may be one or a combination of a stationary or mobile random access memory (RAM), a read-only memory (ROM), a flash memory, a hard drive or other similar devices or integrated circuits.

The processor 114 of the image processing device 110 would be configured to execute the proposed image enhancement method and may be, for example, a central processing unit (CPU) or other programmable devices for general purpose or special purpose such as a microprocessor and a digital signal processor (DSP), a programmable controller, an application specific integrated circuit (ASIC), a programmable logic device (PLD), other similar devices, chips, integrated circuits, or a combination of above-mentioned devices.

The display 120 would be configured to display images. In the present exemplary embodiment, the display 120 would be an organic light-emitting diode (OLED) display. In other exemplary embodiments, the display 120 may be, for example, a liquid crystal display (LCD), a light-emitting diode (LED) display, a plasma display panel, or other types of displays. For illustrative purposes, the display 120 in the present exemplary embodiment, the display 120 would be an emissive display such as OLED display that would independently drive each pixel to display content, i.e. do not require backlight.

Figure 2:
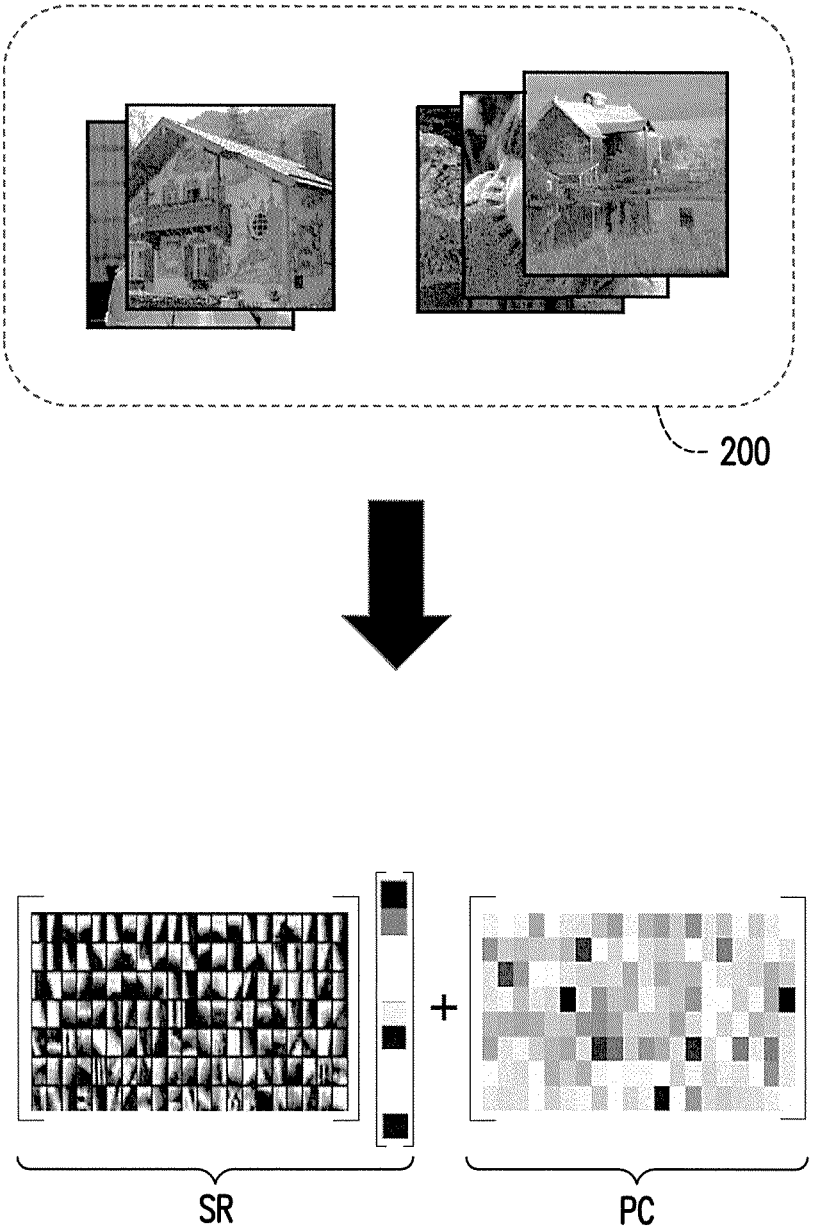
FIG. 2 illustrates a schematic diagram of a PCSR model in accordance with one of the exemplary embodiments of the disclosure.

Herein, the image processing device 110 of the display system may leverage a power-constrained sparse representation (PCSR) model for gaining better power-saving and more perceptible visual-quality on the display 120. To be specific, in terms of a PCSR model as illustrated in FIG. 2 in accordance with one of the exemplary embodiments of the disclosure, all images 200 may be enhanced according to the PCSR model associated with a sparse representation model SR and a power-constrained model PC through an image enhancement method as illustrated in FIG. 3 in accordance with one of the exemplary embodiments of the disclosure.

Figure 3:
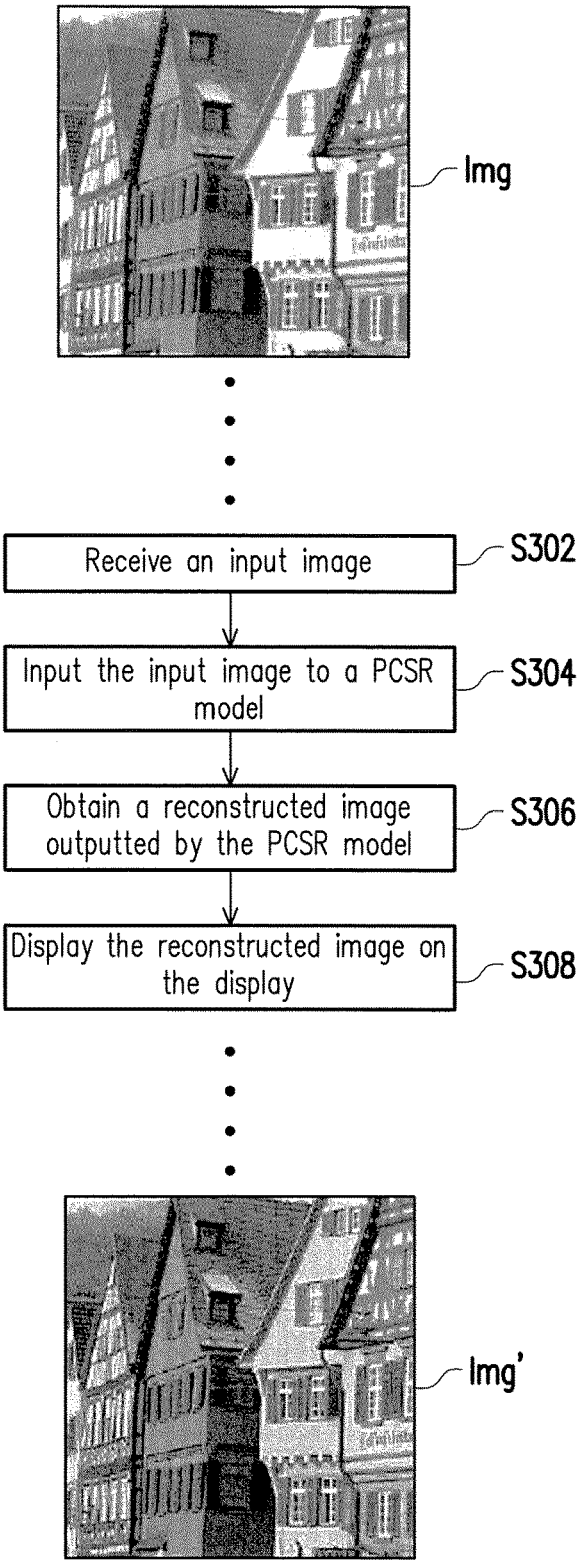
FIG. 3 illustrates a flowchart of an image enhancement method in accordance with one of the exemplary embodiments of the disclosure.

Referring to both FIG. 1 and FIG. 3, the processor 114 of the image processing device 110 would receive an input image Img (Step S302). Next, the processor 114 would input the input image to the PCSR model (Step S304) and obtain a reconstructed image Img' outputted by the PCSR model (Step S306) so as to display the reconstructed image Img' on the display 120 (Step S308). Herein, let an image x be the input image to provide a detailed description on the PCSR model and the steps of the image enhancement method.

Mathematically, the sparse representation model supposes that the image $x \in R^N$ may be represented by Eq.(1):

$$x \approx \Phi\alpha \tag{1}$$

where $\Phi \in R^{n \times M}$ denotes an over-complete dictionary and may be updated from the image x in order for better characterizing image structures, and $\alpha \in R^M$ denotes a sparse coding vector (also referred to as "sparse codes") that is assumed to be zero or close to zero for most entries. Additionally, the image x may be decomposed sparsely by the following formulation of a L0-minimization problem as Eq.(2):

$$\alpha = \underset{\alpha}{\operatorname{argmin}} \|\alpha\|_0, \text{ s.t. } \|x - \Phi\alpha\|_2 < \varepsilon \tag{2}$$

where $\|\cdot\|_0$ and $\|\cdot\|_2$ denote a pseudo norm and a Frobenius norm respectively, and ε denotes a toleration for controlling an approximation error. To make the L0-minimization problem (i.e. NP-hard combinatorial optimization problem) tractable, it is usually relaxed to a convex L1-minimization problem, formulated as Eq.(3):

$$\underset{\alpha}{\operatorname{argmin}} \frac{\beta}{2} \|x - \Phi\alpha\|_2^2 + \lambda \|\alpha\|_1 \tag{3}$$

where β and λ denotes regularization coefficients that may be set to 1.0 and 0.5 respectively. In Eq.(3), the first term $\|x-\Phi\alpha\|_2^2$ represents a data fidelity, and the second term $\|\alpha\|_1$ represents a matrix sparsity. Herein, the above L1-minimization problem in Eq.(3) may be solved by using an orthogonal matching pursuit (OMP) method.

In the case of power-constrained contrast enhancement, assume that the image x is a bright and vivid image composed by several square patches $x_i$ of size $\sqrt{n} \times \sqrt{n}$ extracted by a binary matrix $R_i$ from an ith location, which may be expressed as Eq.(4):

$$x_i = R_i x \tag{4}$$

To reconstruct the image x from the patches $x_i$, each of the patches would be sparsely coded in connection with the over-complete dictionary Φ by minimizing the following energy expressed in Eq.(5):

$$\underset{\alpha_i}{\operatorname{argmin}} \frac{\beta}{2} \|x_i - \Phi\alpha_i\|_2^2 + \lambda \|\alpha_i\|_1 \tag{5}$$

Next, a least-square solution is utilized to reconstruct the image x supposing that the sparse codes α are given as Eq.(6):

$$x \approx \Phi\alpha = \left(\sum_{\forall i} R_i^T R_i\right)^{-1} \left(\sum_{\forall i} R_i^T \Phi\alpha_i\right) \tag{6}$$

That is, Eq.(6) means that the image x is reconstructed by averaging each sparsely-coded patch $x_i$.

In order for effective power-constrained contrast enhancement, the power-constrained model for the display 120 may calculate power consumption based on the specification of pixel intensities in a color space. In the present exemplary embodiment, the power consumption may be calculated according to a luminance component of the pixel intensities. Take a YCbCr color space as an example, the overall power consumption is dominated by a Y-component (i.e. the luminance component). Hence, the representative model may be expressed as Eq.(7):

$$P(x_i) = \sum_{\forall j} x_{i,j}^{\gamma} \tag{7}$$

where $x_{i,j}^{\gamma}$ denotes a luminance component of a pixel intensity at a jth position of a patch $x_i$ and may be regarded as the power consumption with a gamma correction value $\gamma$ for a given display. Typically, $\gamma$ may be set to 2.2 as used in a conventional display. In practice, $\gamma$ would be able to be adaptively adjusted for a better estimation of the power consumption to an arbitrary display. Hence, the power consumption of Eq.(7) may be rewritten as Eq.(8):

$$P(x_i) = \|x_i\|_{\gamma} \tag{8}$$

where $\|\cdot\|_{\gamma}$ denotes a $\gamma$-norm that may be represented as Eq.(9):

$$\|x_i\|_{\gamma} := \left(\sum_{\forall i} |x_i|^{\gamma}\right)^{1/\gamma} \tag{9}$$

In doing so, the power consumption may be calculated and flexibly optimized by the PCSR model.

The definition of the power-constrained model indicates that by suppressing the pixel intensities from the reconstructed image, the power consumption on the display 120 would be improved. However, the sparse representation model in Eq.(5) is expected that each patch $\Phi\alpha_i$ of the reconstructed image should be close enough to the corresponding patch $x_i$ of the input image. This results in the difficulty lies in that which pixel should be degraded is unknown so that $\Phi\alpha$ may not be directed obtained by Eq.(5). Nonetheless, in the present exemplary embodiment, $\Phi\alpha_i$ may have some reasonably degradation, and meantime it is as close as possible to the corresponding patch $x_i$ of the input image, then the reconstructed image $\Phi\alpha$ may be a good representation of the input image x with rich contrast but less power consumption. Therefore, two following objectives would be considered in the proposed PCSR model.

The first objective is to suppress the pixel intensities of the constructed image for power saving. Herein, a power constraint term is introduced in Eq.(8) by improving the objective function of Eq.(3) into Eq.(10):

$$\underset{\alpha}{\operatorname{argmin}} \frac{\beta}{2}\|x - \Phi\alpha\|_2^2 + \lambda\|\alpha\|_1 + \frac{\eta}{2}\|\Phi\alpha\|_{\gamma} \tag{10}$$

where $\eta$ denotes a regularization coefficient. One important issue of power-constrained contrast enhancement is the selection of the gamma correction value $\gamma$ for the display 120. Conventional gamma correction values (e.g. $\gamma$=1.0, $\gamma$=2.0, $\gamma$=2.2) are insufficient to characterize different types of displays. Herein, an adaptive gamma correction strategy is adopted, instead of fixing $\gamma$ to an arbitrary value. This leads the PCSR model possesses a more power-effective and adaptive representation, and consequently a better image reconstruction result. Herein, Eq.(10) may be further written for each patch $x_i$ of the input image into Eq.(11):

$$\underset{\alpha_i}{\operatorname{argmin}} \frac{\beta}{2}\|x_i - \Phi\alpha_i\|_2^2 + \lambda\|\alpha_i\|_1 + \frac{\eta}{2}\|\Phi\alpha_i\|_{\gamma} \tag{11}$$

In the above PCSR model, while enforcing the data-fidelity of sparse codes $\alpha_i$, the sparse codes $\alpha_i$ are also constrained to some degradation of $\|\Phi\alpha_i\|_{\gamma}$ so that the pixel intensities may be suppressed.

On the other hand, the second objective is to improve the contrast of the reconstructed image for contrast enhancement. Herein, consider a total variation (TV) maximization in Eq.(12) as a penalty function to gain a better image contrast while suppressing its pixel intensities:

$$\max_{\alpha_i} \|\nabla(\Phi\alpha_i)\|_{TV} \tag{12}$$

where $\|\nabla(\Phi\alpha_i)\|_{TV}$ denotes a discrete version of an isotropic TV noun with a gradient operator $\nabla$: $R^{\sqrt{n}\times\sqrt{n}} \rightarrow R^{\sqrt{n}\times\sqrt{n}}$ which may be represented as Eq.(13):

$$\|\nabla(\Phi\alpha_i)\|_{TV} = \sum_{\forall j} \sqrt{|\partial_x(\Phi\alpha_i)_j|^2 + |\partial_y(\Phi\alpha_i)_j|^2} \tag{13}$$

where $\partial_x(\Phi\alpha_i)_j$ and $\partial_y(\Phi\alpha_i)_j$ denote the derivatives of $\Phi\alpha_i$ at a jth location along a horizontal direction and a vertical direction respectively. Hence, the objective function in Eq.(11) may be further rewritten as Eq.(14):

$$\underset{\alpha_i}{\operatorname{argmin}} \frac{\beta}{2}\|x_i - \Phi\alpha_i\|_2^2 + \lambda\|\alpha_i\|_1 + \frac{\eta}{2}\|\Phi\alpha_i\|_{\gamma} - \theta\|\nabla(\Phi\alpha_i)\|_{TV} \tag{14}$$

where $\theta$ denotes a regularization coefficient to the total variation constraint.

Thanks to a local total variation constraint $\|\nabla(\Phi\alpha_i)\|_{TV}$, it makes the PCSR model flexible to accommodate a global intensity suppression. This leads to an accurate enough image reconstruction while enhancing the contrast of the image. Therefore, an objective cost function of the PCSR model may be expressed as Eq.(15):

$$\underset{\alpha}{\operatorname{argmin}} \frac{\beta}{2}\sum_{\forall i}\|x_i - \Phi\alpha_i\|_2^2 + \lambda\sum_{\forall i}\|\alpha_i\|_1 + \frac{\eta}{2}\sum_{\forall i}\|\Phi\alpha_i\|_{\gamma} - \theta\sum_{\forall i}\|\nabla(\Phi\alpha_i)\|_{TV} \tag{15}$$

It should be noted that the regularization coefficients $\beta$ and $\lambda$ in Eq.(15) control the fidelity of the reconstructed image to its original version (i.e. the input image x) and the sparsity of the sparse codes $\alpha$ respectively. To seek a good balance between an approximation tolerance of x and the sparsity of $\alpha$, $\beta$ and $\lambda$ may be set to 10 and 0.5 respectively. In other words, the objective herein is to reconstruct an image to be as close as possible to the input image, but still tolerate some error to leave a room for contrast enhancement getting better and better on a desired power consumption level. The regularization coefficient $\gamma$ in Eq.(15) controls the estimation of power consumption for the display 120. A larger $\gamma$ would give a more relaxed estimation to power consumption. Thus, the choice of $\gamma$ would depend on the power consumption level on the display 120. Herein, $\gamma$ may be set to 2.2 as that used by a normal display. Moreover, the regularization coefficient $\theta$ in Eq.(15) controls the estimation of a total variation for a given image patch. With an appropriate selection of θ, a good contrast enhancement of Φα under the desired power consumption level would be achieved. Typically, θ may be set to 1.0, where the contrast of Φα is enhanced as iteration progress.

Moreover, η in Eq.(15) constrains the power consumption of the PCSR model. A higher η processes a lower luminance value due to dominant power constraint, whereas a lower η processes a higher luminance value because of data-fidelity approximation. Hence, the choice of η would depend on the need of the power level on the display 120 for a satisfied data-fidelity. In the present exemplary embodiment, assume that β=10.0, λ=0.5, γ=2.2, and θ=1.0 are given. Compared with the power consumption used in the original input image, when η=2.8, η=1.6, η=1.0, η=0.6, η=0.4, and η=0.1, the power consumption used in the reconstructed image would be respectively constrained to 30%, 40%, 50%, 60%, 70%, and 80% of that used in the original input image.

In the present exemplary embodiment, an iterative alternating algorithm based on a variable splitting method would be used to solve the objective function of the PCSR model in Eq.(15). More specifically, the minimization problem would be separated into four steps by introducing three auxiliary variables.

Herein, the basic idea of the iterative alternating algorithm is to first introduce auxiliary variables $u \in R^n$ and $w \in R^n$ by which to divide the minimization problem of Eq.(15) into a sequence of three simple sub-problems for optimizing α, u, and w as Eq.(16):

$$\underset{\alpha,u,w}{\operatorname{argmin}} \frac{\beta}{2}\sum_{\forall i}\|x_i-u_i\|_2^2+\lambda\sum_{\forall i}\|\alpha_i\|_1+\frac{\eta}{2}\sum_{\forall i}\|u_i\|_\gamma+\frac{\zeta}{2}\sum_{\forall i}\|x_i-\Phi\alpha_i\|_2^2-\theta\sum_{\forall i}\|w_i\|_{TV}+\frac{\mu}{2}\sum_{\forall i}\|w_i-\nabla u_i\|_2^2 \tag{16}$$

where ζ and μ denote regularization coefficients and may be both set to 1.0. Since $\nabla u_i$ denotes a matrix attained by using a gradient operator ∇ from $u_i$, Eq.(16) may be written by introducing a variable $m \in R^n$ into Eq.(17) to make the minimization problem tractable:

$$\underset{\alpha,u,w,m}{\operatorname{argmin}} \frac{\beta}{2}\sum_{\forall i}\|x_i-m_i\|_2^2+\lambda\sum_{\forall i}\|\alpha_i\|_1+\frac{\eta}{2}\sum_{\forall i}\|m_i\|_\gamma+\frac{\zeta}{2}\sum_{\forall i}\|m_i-\Phi\alpha_i\|_2^2-\theta\sum_{\forall i}\|w_i\|_{TV}+\frac{\mu}{2}\sum_{\forall i}\|w_i-\nabla u_i\|_2^2+\frac{\kappa}{2}\sum_{\forall i}\|u_i-m_i\|_2^2 \tag{17}$$

where κ denotes the regularization coefficient and may be set to 1.0. Therefore, the optimal solution of the original minimization problem on Eq.(15) would be eventually converged to solutions of m-step, α-step, u-step, and w-step.

In m-step, given an estimation of the sparse codes α and the variable u, the first sub-problem over u for each image patch turns out to be a convex optimization problem expressed in Eq.(18):

$$\underset{m}{\operatorname{argmin}} \frac{\beta}{2}\sum_{\forall i}\|x_i-m_i\|_2^2+\frac{\eta}{2}\sum_{\forall i}\|m_i\|_\gamma+\frac{\zeta}{2}\sum_{\forall i}\|m_i-\Phi\alpha_i\|_2^2+\frac{\kappa}{2}\sum_{\forall i}\|u_i-m_i\|_2^2 \tag{18}$$

Moreover, for the jth pixel in the ith image patch $x_{i,j}$, Eq.(18) may be further rewritten into a discrete form to facilitate the computation tractable as Eq.(19):

$$\underset{m_{i,j}}{\operatorname{argmin}} \frac{\beta}{2}(x_{i,j}-m_{i,j})^2+\frac{\eta}{2}m_{i,j}^\gamma+\frac{\zeta}{2}(m_{i,j}-(\Phi\alpha_i)_j)^2+\frac{k}{2}(u_{i,j}-m_{i,j})^2 \tag{19}$$

Next, the optimal m in Eq.(19) may be obtained efficiently by using an interior-point method.

In α-step, with m fixed in Eq.(17), the second sub-problem over α may be solved by minimizing Eq.(20):

$$\underset{\alpha}{\operatorname{argmin}} \lambda\sum_{\forall i}\|\alpha_i\|_1+\frac{\zeta}{2}\sum_{\forall i}\|m-\Phi\alpha_i\|_2^2 \tag{20}$$

Moreover, for the ith image patch, Eq.(20) may be further written into Eq.(21) to make the minimization problem tractable:

$$\underset{\alpha_i}{\operatorname{argmin}} \lambda\|\alpha_i\|_1+\frac{\zeta}{2}\|m_i-\Phi\alpha_i\|_2^2 \tag{21}$$

The above energy is a standard form of a basis pursuit denoising (BPDN) problem, which may be solved exactly by using an orthogonal matching pursuit (OMP) method.

In u-step, the third sub-problem over u may be solved by fixing an estimation of w in Eq.(22):

$$\underset{u}{\operatorname{argmin}} \frac{\mu}{2}\sum_{\forall i}\|w_i-\nabla u_i\|_2^2+\frac{\kappa}{2}\sum_{\forall i}\|u_i-m_i\|_2^2 \tag{22}$$

A least squares approach may be used to obtain a closed-form solution of Eq.(22), where the solution may be expressed as Eq.(23):

$$u=(\mu\nabla^*\nabla+kI)(\mu\nabla^*w+km) \tag{23}$$

where ∇*=−div and denotes a complex conjugate transpose of a bidirectional gradient operator ∇ along a horizontal direction and a vertical direction. Thus, ∇*w may be further expressed as Eq.(24):

$$\nabla^*w=(\partial^*_x w+\partial^*_y w) \tag{24}$$

In w-step, for a fixed u, a L2,1-norm minimization problem over w as expressed in Eq.(25) would be solved:

$$\underset{w}{\operatorname{argmin}} \frac{\mu}{2}\sum_{\forall i}\|w_i-\nabla u_i\|_2^2-\theta\sum_{\forall i}\|w_i\|_{TV} \tag{25}$$

A least absolute shrinkage algorithm may be adopted to solve Eq.(25), and Eq.(26) would then be obtained:

$$w = \text{shink}\left(\nabla u, -\frac{\theta}{\mu}\right) \tag{26}$$

where shink(·) is a shrinkage operator and may be defined component-wise as Eq.(27):

$$\text{shink}\left(\nabla u, -\frac{\theta}{\mu}\right) := \max\left(\|\nabla u\|_2 + \frac{\theta}{\mu}, 0\right)\frac{\nabla u}{\|\nabla u\|_2} \tag{27}$$

Figure 4:
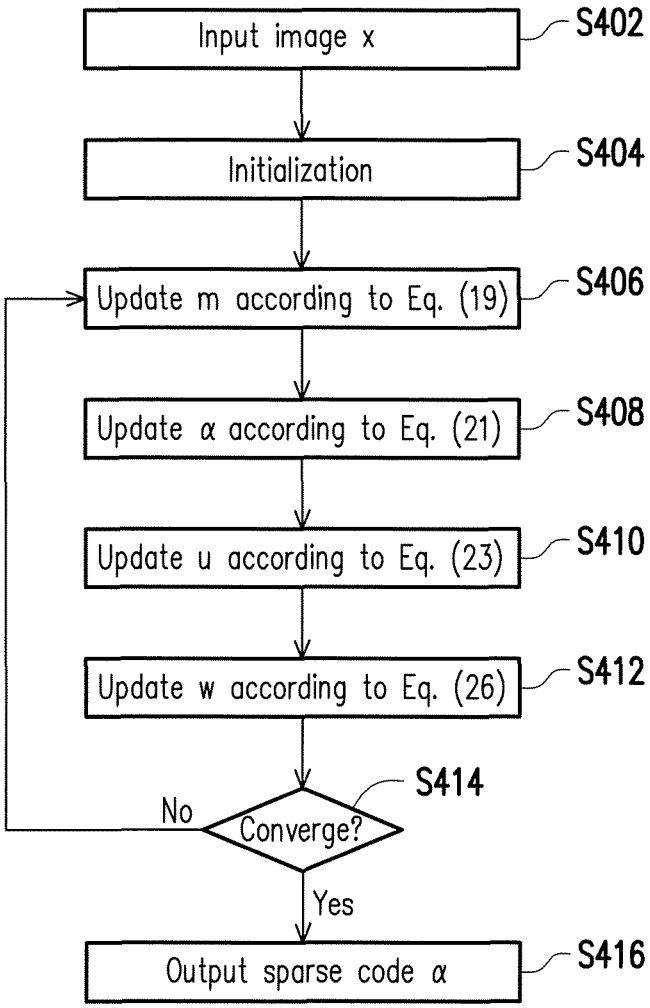
FIG. 4 illustrates a flowchart of a sparse codes estimation method in accordance with one of the exemplary embodiments of the disclosure.

Accordingly, the optimal solution to Eq.(15) may be obtained efficiently by using m-step, α-step, u-step, and w-step iteratively as demonstrated in, for example, a flowchart of a sparse codes estimation method in FIG. 4 in accordance of an exemplary embodiment of the disclosure.

Referring to FIG. 4, the processor 114 would receive an input image x (Step S402). Next, the processor 114 would perform initialization on coefficients: setting a sparse weight $\lambda \leftarrow 0.5$, setting a regularization coefficient $\zeta \leftarrow 1.0$, setting a regularization coefficient $\mu \leftarrow 1.0$, setting a regularization coefficient $\kappa \leftarrow 1.0$, setting a data-fidelity weight $\beta \leftarrow 10$, setting a power-consumption weight η (Step S404). As illustrated previously, η may be set based on the power consumption required to be constrained. For example, when η=0.4, the power consumption would be constrained to 70% of the original input image. During iterations, the processor 114 would update m according to Eq.(19) (Step S406), update α according to Eq.(21) (Step S408), update u according to Eq.(23) (Step S410), and update w according to Eq.(26) (Step S412).

Next, the processor 114 would determine whether the updated m, α, u, and w would converge the energy of the PCSR model (Step S414), where the energy of the PCSR model is the value of the objective cost function in Eq.(15). The interior-point method, the OMP method, and the least absolute shrinkage method all possess a convergence property. In addition, in the present exemplary embodiment, Eq.(28) may be used to determine the convergence:

$$\psi = \frac{E_t - E_{t-1}}{E_t} \tag{28}$$

where $E_t$ denotes a total energy of the PCSR model at a tth iteration, $E_{t-1}$ denotes a total energy of the PCSR model at a (t−1)th iteration, and the PCSR model converges when is ψ less than a preset difference.

When the determination of Step S414 is no, the processor 114 would return to Step S406 for another iteration. When the determination of Step S414 is yes, the processor 114 would output the current sparse codes α as the optimal solution (Step S416) and end the flow of the sparse codes estimation method.

In view of the aforementioned descriptions, the method, the image processing device, and the display system for power-constrained image enhancement as proposed in the disclosure use the PCSR model in order to provide contrast enhancement on output images as well as power saving on a display. The proposed image enhancement technique may be applicable to consumer electronic products so that the practicability of the disclosure is assured.

No element, act, or instruction used in the detailed description of disclosed embodiments of the present application should be construed as absolutely critical or essential to the present disclosure unless explicitly described as such. Also, as used herein, each of the indefinite articles "a" and "an" could include more than one item. If only one item is intended, the terms "a single" or similar languages would be used. Furthermore, the terms "any of" followed by a listing of a plurality of items and/or a plurality of categories of items, as used herein, are intended to include "any of", "any combination of", "any multiple of", and/or "any combination of multiples of the items and/or the categories of items, individually or in conjunction with other items and/or other categories of items. Further, as used herein, the term "set" is intended to include any number of items, including zero. Further, as used herein, the term "number" is intended to include any number, including zero.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A power-constrained image enhancement method, applicable to an image processing device, wherein the method comprises the following steps:

receiving an input image;

inputting the input image to a power-constrained sparse representation (PCSR) model, wherein the PCSR model is associated with an over-complete dictionary and sparse codes, and wherein the PCSR model is associated with pixel intensities of the input image and a gamma correction value of a display;

receiving a reconstructed image outputted by the PCSR model; and displaying the reconstructed image on the display, wherein the input image is represented by the PCSR model as follows:

$$x \approx \Phi\alpha = \left(\sum_{\forall i} R_i^T R_i\right)^{-1}\left(\sum_{\forall i} R_i^T \Phi\alpha_i\right),$$

wherein x denotes the input image, Φα denotes the reconstructed image, Φ denotes the over-complete dictionary and $\Phi \in R^{n \times M}$, and $\alpha \in R^M$ denotes a vector of the sparse codes, $R_i$ denotes a binary matrix and is able to extract a square patch from an ith position of the input image.

2. The method according to claim 1, wherein the PCSR model is expressed as follows:

$$P(x_i) = \sum_{\forall j} x_{i,j}^{\gamma}$$

wherein $x_{i,j}^{\gamma}$ denotes a luminance component of the pixel intensity at a jth position of a patch $x_i$ of the input image, and γ denotes the gamma correction value of the display.

3. The method according to claim 1, wherein a cost function of the PCSR model is constructed according to a data fidelity, a matrix sparsity, a preset degradation level, and a local total variation constraint.

4. The method according to claim 3, wherein the cost function of the PCSR model is expressed as follows:

$$\underset{\alpha}{\operatorname{argmin}} \frac{\beta}{2} \sum_{\forall i} \| x_i - \Phi\alpha_i \|_2^2 + \lambda \sum_{\forall i} \| \alpha_i \|_1 + \frac{\eta}{2} \sum_{\forall i} \| \Phi\alpha_i \|_\gamma - \theta \sum_{\forall i} \| \nabla(\Phi\alpha_i) \|_{TV}$$

wherein $\|x_i-\Phi\alpha_i\|_2^2$, $\|\alpha_i\|_1$, $\|\Phi\alpha_i\|_\gamma$, and $\|\nabla(\Phi\alpha_i)\|_{TV}$ respectively correspond to the data fidelity, the matrix sparsity, the preset degradation level, and the local total variation constraint of the patch $x_i$ of the input image, wherein β, λ, and η denote regularization coefficients, wherein $\Phi\alpha_i$ denotes a patch in the reconstructed image corresponding to a patch $x_i$.

5. The method according to claim 4, wherein a value of η is associated with power consumption of the display, and wherein the less the value of η is, the more the power consumption is constrained.

6. The method according to claim 4, wherein the step of solving α comprises:

introducing three auxiliary variables to the cost function of the PCSR model;

dividing the cost function of the PCSR model with the three auxiliary variables into four sub-problems, wherein the sub-problems are a convex optimization problem, a basis pursuit denoising problem, a least square problem, and a L21-norm minimization problem; and obtaining α by applying an iterative alternating algorithm on the sub-problems.

7. The method according to claim 6, wherein the convex optimization problem is solved by an interior point method.

8. The method according to claim 6, wherein the basis pursuit-denoising problem is solved by an orthogonal matching pursuit method.

9. The method according to claim 6, wherein the least square problem includes a closed-form solution.

10. The method according to claim 6, wherein L21-norm minimization problem is solved by a least absolute shrinkage algorithm.

11. The method according to claim 1, wherein the choice of the gamma correction value is changeable and depends on a power consumption level on the display.

12. The method according to claim 1 further comprising:

updating the over-complete dictionary according to the input image.

13. An image processing device, connected to a display, and comprising:

a memory, configured to store image and data; and a processor, coupled to the memory and configured to:

receive an input image;

input the input image to a power-constrained sparse representation (PCSR) model, wherein the PCSR model is associated with an over-complete dictionary and sparse codes, and wherein the PCSR model is associated with pixel intensities of the input image and a gamma correction value of a display;

receive a reconstructed image outputted by the PCSR model; and display the reconstructed image on the display, wherein the input image is represented by the PCSR model as follows:

$$x \approx \Phi\alpha = \left(\sum_{\forall i} R_i^T R_i\right)^{-1} \left(\sum_{\forall i} R_i^T \Phi\alpha_i\right),$$

wherein x denotes the input image, Φα denotes the reconstructed image, Φ denotes the over-complete dictionary and $\Phi \in R^{n \times M}$, and $\alpha \in R^M$ denotes a vector of the sparse codes, $R_i$ denotes a binary matrix and is able to extract a square patch from an ith position of the input image.

14. The image processing device according to claim 13, wherein the display is an emissive display.

15. The image processing device according to claim 13, wherein a choice of the gamma correction value is changeable and depends on a power consumption level on the display.

16. A display system comprising:

a display, configured to display images; and an image processing device, connected to the display and configured to:

receive an input image;

input the input image to a power-constrained sparse representation (PCSR) model, wherein the PCSR model is associated with an over-complete dictionary and sparse codes, and wherein the PCSR model is associated with pixel intensities of the input image and a gamma correction value of a display;

receive a reconstructed image outputted by the PCSR model; and display the reconstructed image on the display, wherein the input image is represented by the PCSR model as follows:

$$x \approx \Phi\alpha = \left(\sum_{\forall i} R_i^T R_i\right)^{-1} \left(\sum_{\forall i} R_i^T \Phi\alpha_i\right),$$

wherein x denotes the input image, Φα denotes the reconstructed image, Φ denotes the over-complete dictionary and $\Phi \in R^{n \times M}$, and $\alpha \in R^M$ denotes a vector of the sparse codes, $R_i$ denotes a binary matrix and is able to extract a square patch from an ith position of the input image.

17. The display system according to claim 16, wherein the display is an emissive display.

18. The display system according to claim 16, wherein a choice of the gamma correction value is changeable and depends on a power consumption level on the display.

* * * * *